United States Patent [19]

Nicholas

[11] 4,372,288

[45] Feb. 8, 1983

[54] OUTSIDE COMBUSTION AIR UNIT FOR MASONRY FIREPLACE

[76] Inventor: James E. Nicholas, 211 W. Hess St., Bushnell, Ill. 61422

[21] Appl. No.: 166,415

[22] Filed: Jul. 8, 1980

[51] Int. Cl.[3] ..... F24B 13/02

[52] U.S. Cl. ..... 126/143; 126/285 R

[58] Field of Search ..... 126/120, 143, 135, 77, 126/285 R, 290, 288, 121; 98/41 AV

[56] References Cited

U.S. PATENT DOCUMENTS

| | | | |
|---|---|---|---|
| 2,497,486 | 2/1950 | Barber | 126/120 |
| 4,136,666 | 1/1979 | Haas | 126/143 |
| 4,184,474 | 1/1980 | Pulliam et al. | 126/143 |
| 4,249,510 | 2/1981 | Anderson | 126/121 |

*Primary Examiner*—Samuel Scott

*Assistant Examiner*—Lee E. Barrett

*Attorney, Agent, or Firm*—Clarence A. O'Brien & Harvey B. Jacobson

[57] ABSTRACT

An elongated air manifold is provided to be positioned with the manifold extending across the opening of a fireplace closed by conventional glass doors. The manifold is disposed inward of the glass doors and includes outlet openings spaced longitudinally therealong and a shiftable damper plate for variably opening and closing the outlet openings. The opposite ends of the manifold include air inlet openings with which air ducts opening to the exterior of an associated building are communicated and the air inlet openings of the manifold have valve structures operatively associated therewith for variably opening and closing the air inlet openings. The valve structures and the damper plate may be operated from within the fireplace.

3 Claims, 6 Drawing Figures

OUTSIDE COMBUSTION AIR UNIT FOR MASONRY FIREPLACE

BACKGROUND OF THE INVENTION

It has recently become appreciated by the general public that a fireplace opening into a building room and not provided with glass doors or the like closing the fireplace relative to the room into which the fireplace opens draws considerable room air into the fireplace for supporting combustion within the fireplace and thus reduces the air pressure within the building into which the fireplace opens. A reduction of air pressure within the building allows outside air to be drawn into the building through the numerous spaces and voids inherent in most building constructions with the result that many fireplaces actually cause a reduction of temperature within a building as opposed to increasing the temperature within the building. While the room into which an open fireplace opens may be warmed by a fire within the fireplace, during cold weather sufficient outside air is drawn into other areas of the building to actually effect a reduction of average internal temperature of the building. Accordingly, a need exists for means to supply the interior of a fireplace with combustion air from the exterior of the building in conjunction with a glass door assembly or the like which closes the fireplace relative to the room into which the fireplace opens.

Various forms of outside air vents for fireplaces including some of the general structural and operational features of the instant invention are disclosed in U.S. Pat. Nos. 948,007, 2,819,711, 3,538,909, 4,108,144 and 4,136,666.

BRIEF DESCRIPTION OF THE INVENTION

The outside combustion air unit of the instant invention has been specifically designed to enable outside combustion air to be supplied to a fireplace equipped with a glass door closing the fireplace relative to the room into which the fireplace would otherwise open. The outside combustion air unit includes a pair of outside air inlets each provided with a suitable valve for variably controlling the admission of outside air into the unit and the unit further includes a plurality of air outlet openings for discharging combustion air into the associated fireplace and a shiftable damper to variably open and close the air outlet openings from within the associated fireplace.

The main object of this invention is to provide an outside combustion air unit for a masonry fireplace.

Another object of this invention is to provide a combustion air unit in accordance with the preceding object and including structure whereby the admission of outside air into the unit may be varied and the discharging of outside combustion air from the unit into the fireplace may be varied.

Still another object of this invention is to provide an outside combustion air unit including a pair of outside combustion air inlets open to different outside areas and thereby operative to readily compensate for localized outside area pressure differentials.

A final object of this invention to be specifically enumerated herein is to provide an outside combustion air unit for masonry fireplaces which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates a conventional form of fireplace opening into a room 12 of a building and including a hearth 14 which projects into the room 12.

Figure 2:
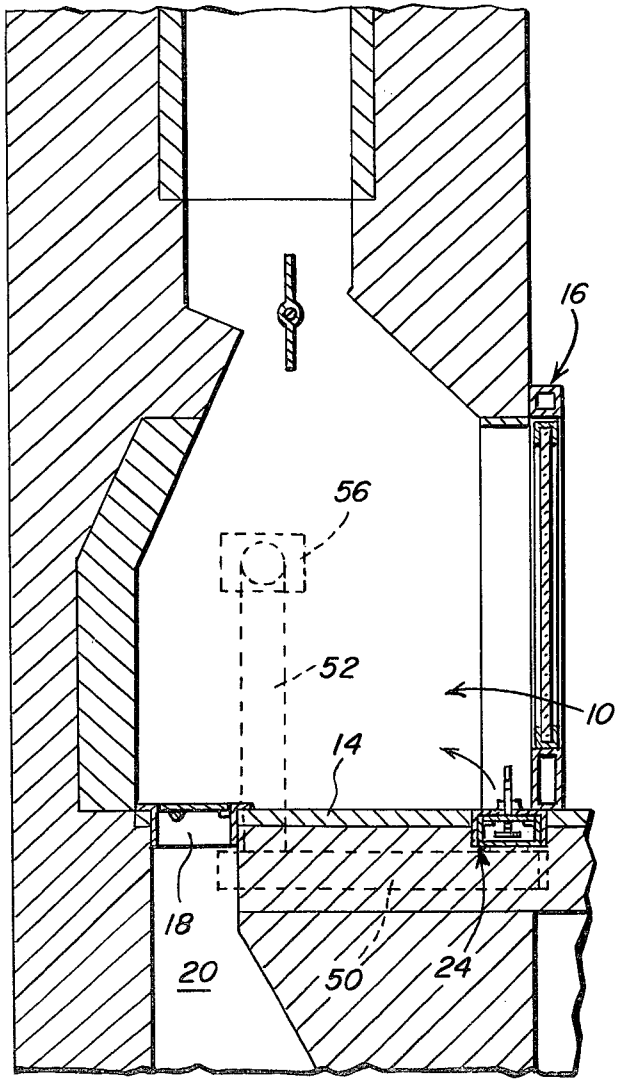
FIG. 2 is a vertical sectional view taken substantially upon the plane indicated by the section line 2—2 of FIG. 1 and illustrating the glass door assembly of the fireplace in place.

The general fireplace structure may be considered as conventional and from FIG. 2 of the drawings it may be seen that a glass door assembly referred to in generally by the reference numeral 16 is mounted in closing relation to the fireplace opening to prevent the flow of air from the room 12 into the fireplace 10.

The fireplace 10 includes an ash door 18 closing the upper end of a passage 20 leading to an ash pit and the combustion air unit of the instant invention is referred to in general by the reference numeral 22 and is "built in" to the fireplace 10.

The unit 22 includes an elongated air inlet manifold referred to in general by the reference numeral 24 recessed within the hearth or floor 14 of the fireplace and extending across the opening thereof. The manifold 24 includes opposite end depending air inlet nipples 26 which project downwardly from opposite end portions of the bottom wall 28 of the manifold 24 and the upper wall 30 of the manifold 24 threadedly supports threaded support shafts 32 carrying circular valve members 34 from their lower ends within the opposite ends of the manifold 24 and in vertical registry with the air inlet nipples 26. The upper ends of the support shafts 32 include thumb and finger engageable portions 36 whereby the shafts 32 may be threaded in order raise and lower the valve members 34 relative to the adjacent ends of the air inlet nipples to thereby vary the flow of air into the manifold 24 through the inlet nipples 26.

The opposite side walls of the manifold 24 include inwardly projecting support flanges 38 spaced slightly below the top wall 30 and a damper plate 40 is slidingly supported from the flanges 38 for longitudinal reciprocation longitudinally of the manifold 24. The top wall 30 has outlet openings 42 formed therein and the damper plate includes similar openings 44 formed therein variably registrable with the openings 42. The top wall 30 includes a longitudinal slot 46 formed therein and an upwardly projecting handle 48 carried by the damper plate 40 is slidably received in the slot 46.

The masonry fireplace also has a pair of inlet ducts 50 incorporated therein including outlet ends downwardly into which the air inlet necks 26 open and inlet ends into which air inlet pipe sections 52 open. The inlet pipe sections 52 include horizontally directed inlet portions 54 thereof which open through the masonry construction of the fireplace 10 and include outside air inlets 56 supported therefrom. It will be noted that the outside air inlets 56 open outwardly of different exterior sides of the fireplace 10 and, therefore, that any localized changes in ambient pressure may be readily compensated for in order to enable the fireplace 10 to effect a constant rate of supply of combustion air to the fire therewithin.

Figure 1:
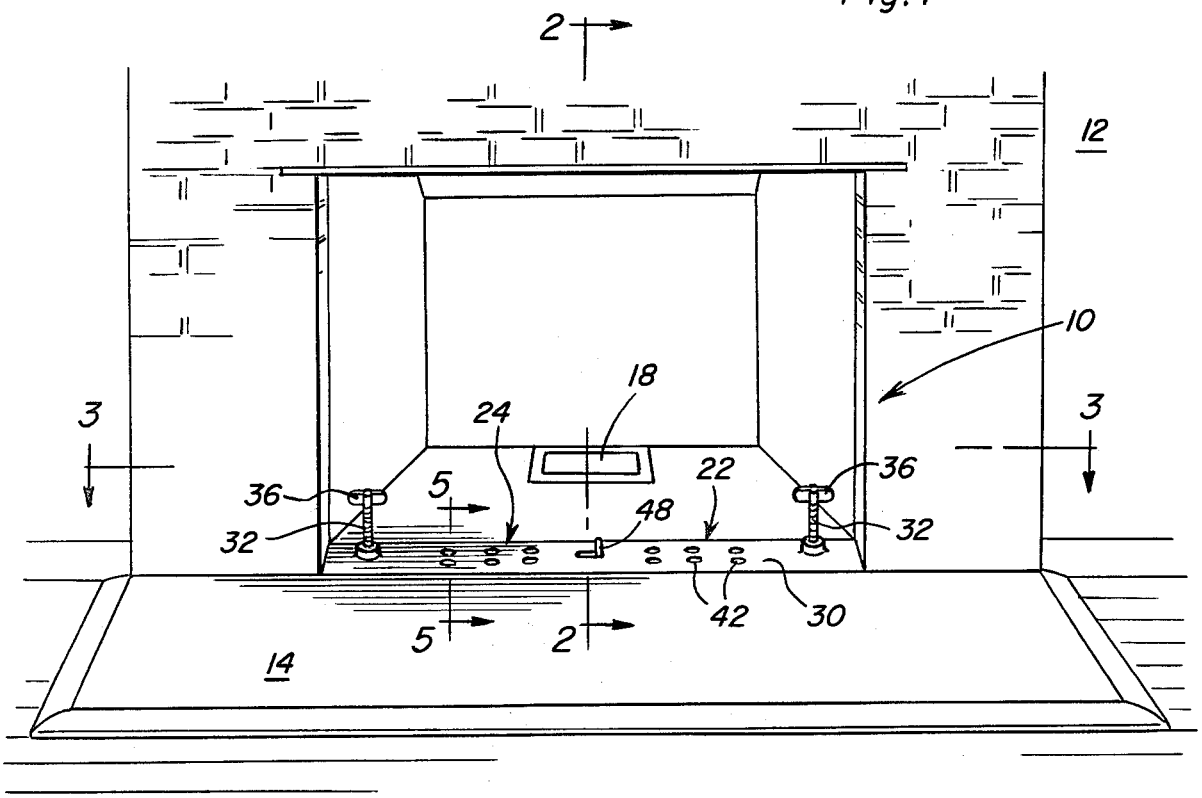
FIG. 1 is a perspective view of a conventional form of fireplace with the glass door assembly thereof removed and illustrating the combustion air inlet unit of the instant invention in operative association with the fireplace.
Figure 5:
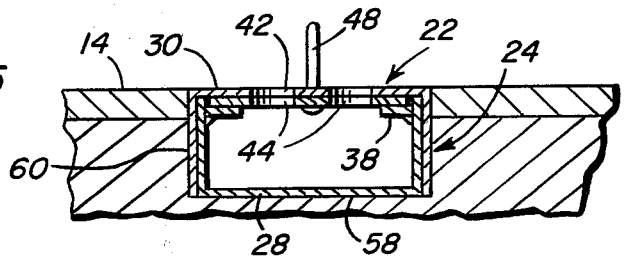
FIG. 5 is a fragmentary enlarged vertical sectional view taken substantially upon the plane indicated by the section line 5—5 of FIG. 1.
Figure 6:
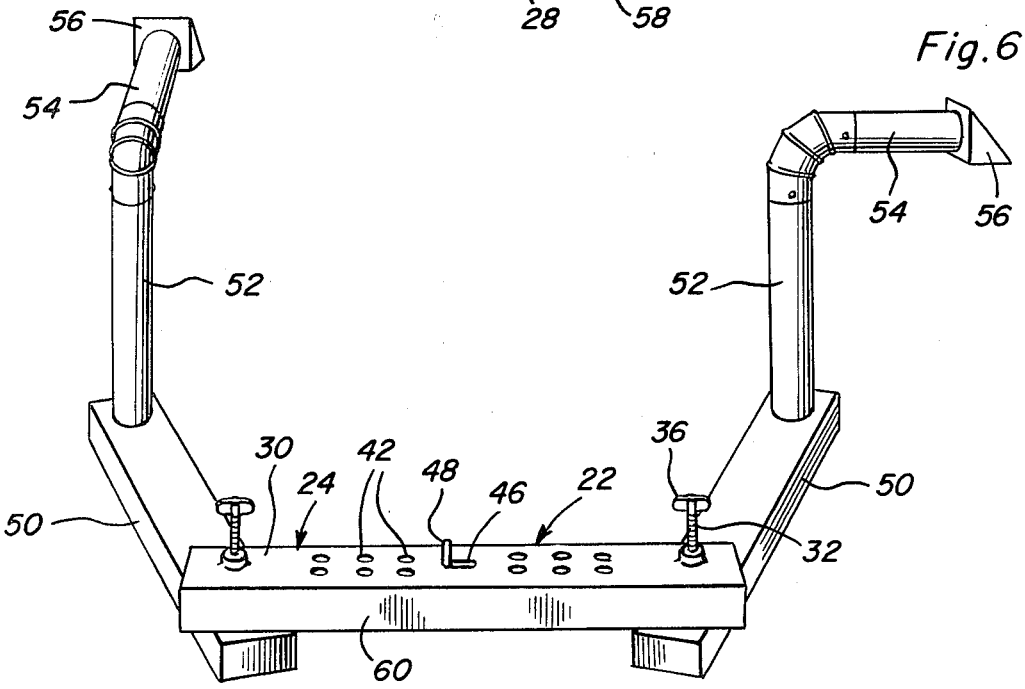
FIG. 6 is a perspective view of the combustion air inlet unit removed from the associated fireplace.
Figure 3:
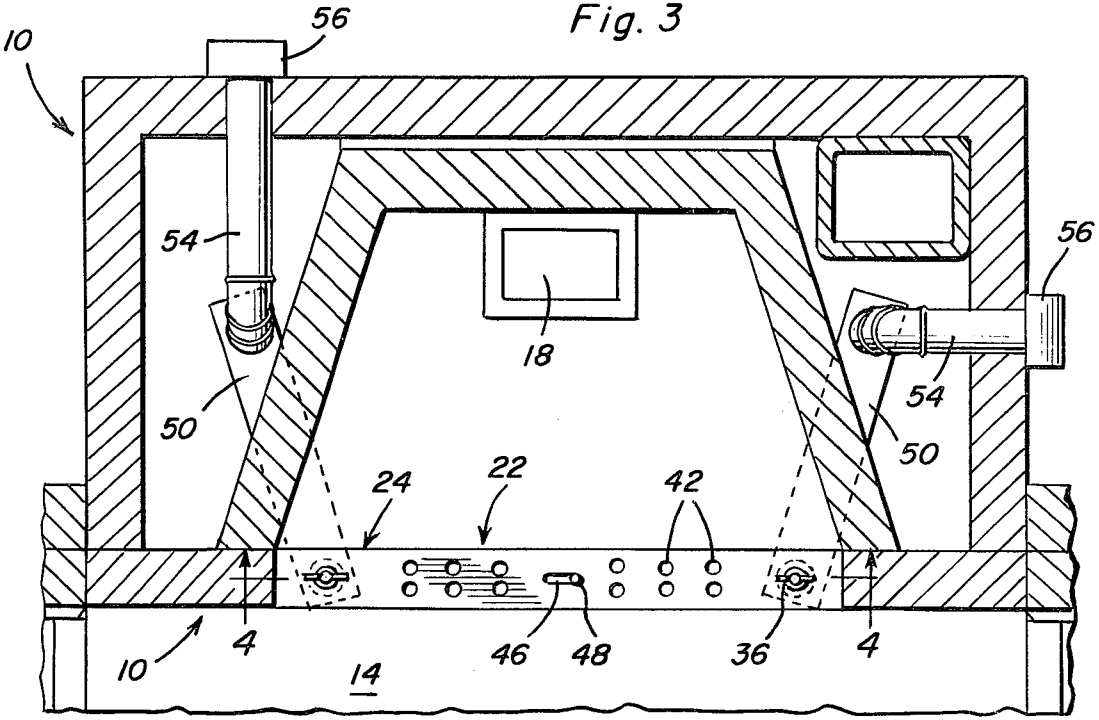
FIG. 3 is a horizontal sectional view taken substantially upon the plane indicated by the section line 3—3 of FIG. 1.
Figure 4:
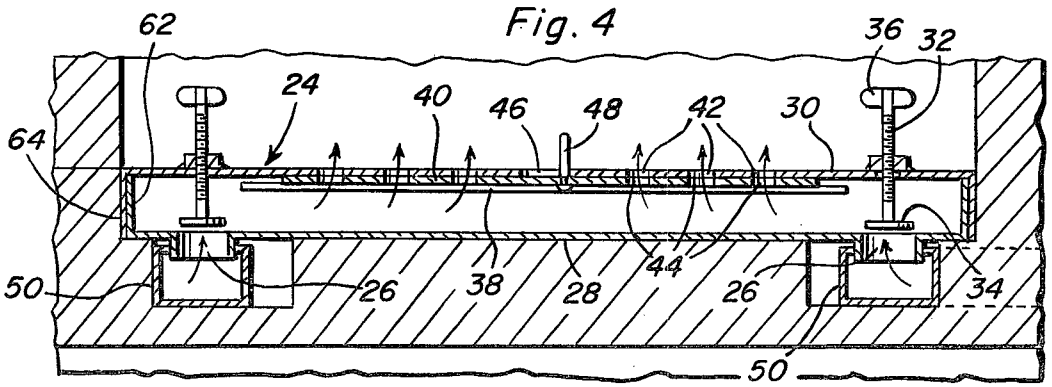
FIG. 4 is a fragmentary enlarged vertical sectional view taken substantially upon the plane indicated by the section line 4—4 of FIG. 3.

With attention now invited more specifically to FIG. 5 of the drawings, it may be seen that the manifold 24 actually comprises an inner upwardly opening channel member 58 defining the bottom wall 28 and from which the support flanges 38 are supported and an outer downwardly opening channel member 60 into which the channel member 58 is upwardly telescoped and secured. The channel member 60 defines the top wall 30 and in this manner an effective inlet manifold may be constructed from two channel members, the inlet members 58 and 60 including upwardly and downwardly directed integral end flanges 62 and 64 respectively (see FIG. 4).

As hereinbefore set forth, the glass door assembly 16 closes the interior of the fireplace 10 from the interior of the room 12. Accordingly, all combustion air passing into the fireplace 10 must pass through the unit 22. Further, the valve members 34 may be adjusted as desired in order to effect a substantially continuous supply of fresh ambient air into the fireplace 10 under the control of the damper plate 40. The valve members 34 may be variably adjusted according to prevailing wind conditions and localized atmospheric pressure at the air inlets 56.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a building having a fireplace opening into one room of the building and with the fireplace having a glass or similar material door operatively associated with the opening thereof in a manner to substantially prevent the entrance of room air into the fireplace, said fireplace including a hearth, an elongated hearth supported hollow housing disposed in said fireplace inwardly of said door and extending across the fireplace opening, said housing including a plurality of outlet openings spaced therealong and including damper means for variably opening and closing said outlet openings, the opposite ends of said housing including air inlet openings and valve structure operatively associated with said inlet openings for variably closing the latter, air inlet duct structures including outlet ends communicated with said inlet openings and inlet ends opening to the exterior of the building in which said fireplace is disposed through different exterior sides of said fireplace, said housing being recessed within said hearth and said inlet openings of said housing opening upwardly through an upper portion of said housing, said housing inlet openings opening downwardly through downwardly projecting tubular inlet nipples supported from the opposite ends of the lower portion of said housing, said valve structures including valve members threadedly supported from said housing upper portion and vertically adjustable downwardly toward and away from the upper ends of said tubular nipples through the upper portion of said housing, said outlet ends of said inlet duct structures underlying said opposite ends of said housing and having upwardly facing openings formed therein downwardly through which said nipples project into said inlet duct structures.

2. The combination of claim 1 wherein said damper means includes a damper plate supported within said housing beneath said upper portion thereof and including openings formed therethrough registered with said housing outlet openings, said damper plate being supported from said housing for shifting relative thereto for variably registering said damper plate openings with said housing outlet openings.

3. The combination of claim 2 wherein said upper portion of said housing includes a longitudinal slot formed therein, said damper plate including a handle projecting upwardly therefrom and slidingly received in said slot, said damper plate being supported from said housing for shifting longitudinally of the latter.

* * * * *